US005138960A

United States Patent [19]

Inteso

[11] Patent Number: 5,138,960

[45] Date of Patent: Aug. 18, 1992

[54] EMBROIDERY AND MONOGRAMMING FRAME

[76] Inventor: Ronald N. Inteso, 6311 De Soto Ave., Unit L, Woodland Hills, Calif. 91367

[21] Appl. No.: 646,237

[22] Filed: Jan. 28, 1991

[51] Int. Cl.[5] ..... D05C 9/04

[52] U.S. Cl. ..... 112/103

[58] Field of Search ..... 112/103, 121.15, 121.12; 38/102, 102.1, 102.2, 102.91; 40/600, 603, 152, 155; 269/8

[56] References Cited

U.S. PATENT DOCUMENTS

| | | | |
|---|---|---|---|
| 3,664,288 | 5/1972 | Von Boden et al. | 112/103 |
| 4,208,975 | 6/1980 | Teetz | 112/103 X |
| 4,236,331 | 12/1980 | Mattson | 40/600 X |
| 4,422,251 | 12/1983 | Hendrick | 38/102.2 |
| 4,475,300 | 10/1984 | Ledenican | 40/600 |
| 4,831,753 | 5/1989 | Inteso | 112/103 X |
| 4,834,006 | 5/1989 | Goto | 112/103 |
| 4,981,092 | 1/1991 | Bauman et al. | 112/103 |

FOREIGN PATENT DOCUMENTS

| | | | |
|---|---|---|---|
| 2614186 | 10/1988 | France | 40/600 |

*Primary Examiner*—Werner H. Schroeder
*Assistant Examiner*—Paul C. Lewis
*Attorney, Agent, or Firm*—Rapkin, Gitlin & Moser

[57] ABSTRACT

A device for use in the process of embroidering fabric which has a generally rectangular appearance and is comprised principally of two elements, a bottom or base section and a corresponding and coincidentally alignable top section. Applied to the mating surfaces of each section are means to magnetically affix and secure the two sections together to ensure that the material held tightly in between provides a taut and flat surface suitable for embroidering. The device of the present invention also allows for the proper adjustment of the portions of the fabric overhanging the borders of the frame and is instrumental in avoiding the potential for distortion and the indelible marks that would otherwise appear on the fabric as a result of the embroidery operation.

2 Claims, 3 Drawing Sheets

EMBROIDERY AND MONOGRAMMING FRAME

FIELD OF INVENTION

The present invention relates generally to the field of embroidering and monogramming and more particularly to a device for use in holding and securing fabric and a variety of other items and materials taut and flat during the embroidery process.

DESCRIPTION OF THE PRIOR ART

High-speed multi-head embroidery machines have revolutionized the embroidery industry. Embroidery operations are now more cost effective and productive as a result. A critical step in the embroidery operation involves the process of mounting the fabric or item to be embroidered. This process is normally referred to in the trade as hooping or framing. In practice, the fabric is placed across or over a female embroidery hoop. The male hoop, which has a slightly smaller circumference than its female counterpart, is then placed over the fabric, thus defining the embroidery target area, and pushed firmly down to engage the female hoop. The engagement of the two hoops acts to firmly secure the fabric to hold it taut and flat and provide a proper working surface. After the hooping process is complete, the hoops are attached to an embroidery machine, normally referred to as a pantograph, where the fabric is embroidered or monogrammed.

Problems seem to arise, however, when the embroidery process is complete and the fabric is removed from the hoops. Because the fabric or item secured in the hoops must be stretched taut and flat to provide a proper working surface and enable the embroidery operation to be performed effectively, the two hoops must engage each other tightly. Thus, the fabric squeezed or sandwiched between the opposing side walls of the hoops is under extreme pressure ultimately resulting in the distortion of the fabric areas affected. In turn, the fabric within the embroidery target area (i.e. inside the area defined by the engaged hoops) is subjected to a severe amount of stretching. The fabric areas immediately adjacent and located just outside the hoops become distorted as well.

The hooping process also causes additional problems. In the process of stretching the fabric to make it taut and flat, the individual threads of fabric within the affected area are forced apart and kept separated. During the embroidery operation, new thread is introduced into some of these areas. After the embroidered fabric is removed from the hoops the original threads attempt to contract. However, the newly introduced threads within the embroidered areas interfere with the normal contraction of the original threads resulting in the affected embroidered areas becoming distorted and unattractive in their appearance.

Marks, or indentations in the fabric, are also apparent where the male and female hoops once engaged to create a taut and flat working surface. These marks are indelible as they are difficult, if not almost impossible, to totally remove. The best results are achieved through the process of steaming and brushing the affected areas, though this method is never completely effective.

The device of the present invention provides the means to resolve the problems, as heretofore described. The present invention involves the use of cooperating frame members that are flat and usually, though not always, rectangular or square in shape and engage each other and remain connected through magnetic means applied to the mating surfaces of each of the members. The bottom member of the frame acts as a base upon which the fabric is laid out and prepared for the application of the embroidery. The top cooperating member of the frame is then positioned so that all the sides of the adjoinable members are coincidental when the fabric is sandwiched in between. After the two members are joined, adjustments to the fabric can be made to create the taut and flat working surface suitable for embroidering.

Thus, the present invention now enables the fabric or any other suitable item to be embroidered without the distortion, indelible markings and other problems normally associated with embroidered materials produced by the prior art methods and devices.

SUMMARY OF THE INVENTION

The present invention provides a device for use in the process of embroidering fabric. The device has a generally rectangular appearance and is comprised principally of two elements, a bottom or base section and a corresponding and coincidentally alignable top section. Applied to the mating surfaces of each section are means to magnetically affix and secure the two sections together. In practice, an item of fabric or a section of a garment is placed over the base section allowing the edges of the fabric or garment to extend or hang freely over the sides. The top section of the device is then carefully placed over the bottom section so that the corresponding mating surfaces are in direct alignment to tightly secure the fabric or section of garment sandwiched in between. The material is then adjusted to provide for a taut and flat working surface suitable for embroidering. Using the device of the present invention, a proper adjustment of the portions of the fabric or material overhanging the borders of the frame can easily be accomplished while avoiding the potential for distorting and indelibly marking the fabric during the embroidery process.

Accordingly, an object of the present invention is to provide an embroidery frame which is designed to avoid distortion of and indelible marks in the embroidered fabric.

Another object of the present invention is to provide an embroidery frame which prevents the fabric from puckering as a result of the embroidery process and eliminates the need later to press or iron out any undesirable marks that might remain.

Still another object of the present invention is to provide an embroidery frame which prevents interference with the normal elasticity of the fabric that might otherwise occur during the embroidery process.

Yet still another object of the present invention is to provide an embroidery frame which can be easily and effectively manufactured.

Yet still another object of the present invention is to provide an embroidery frame which is simple and efficient to use.

Other objects and advantages of the present invention will become apparent in the following specifications when considered in light of the attached drawings wherein a preferred embodiment of the invention is illustrated.

A BRIEF DESCRIPTION OF THE DRAWINGS

DETAILED DESCRIPTION OF THE PREFERRED EMBODIMENT

Figure 1:
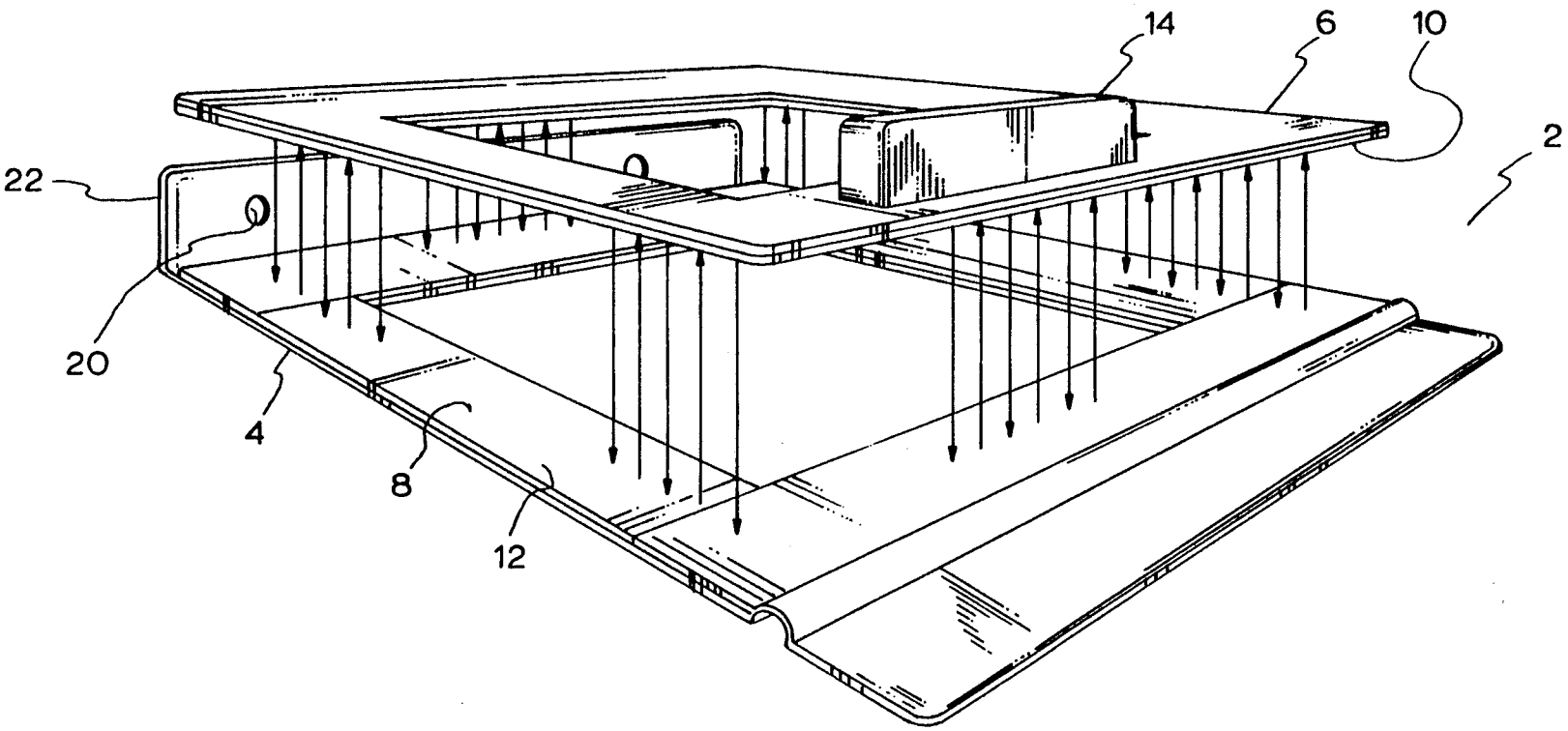
FIG. 1 is a partially exploded view of the main components of the present invention and the magnetic forces acting in accordance therewith.

Referring more particularly to the drawings, FIG. 1 is a perspective view of the present invention in its preferred form. Device 2 of the present invention is an embroidery fixture comprised of two parts, a base frame member 4 and a cooperating face frame member 6. As shown in FIG. 1, face frame member 6 may be moved as a separate and independent element generally along a vertically oriented axis relative to base frame member 4. Applied to surface 8 of the base frame member 4 and surface 10 of the face frame member 6 are elongated strips of magnetic tape 12. Although magnetic tape is preferred in accordance with the present invention, any magnetic or magnetized vehicle for achieving the same purposes may be utilized. When the frame members 4 and 6 are properly aligned and their respective surfaces 8 and 10 coincide, the members 4 and 6 are brought together in direct contact and held there tightly by the attractive forces exerted by the magnetic tape 12. A handle 14 or lever 15, which utilizes a fulcrum or similar device may be used to break the magnetic connection and facilitate the separation of the members 4 and 6 anytime it is necessary to disconnect the two members, including when the embroidery process is complete.

Figure 2:
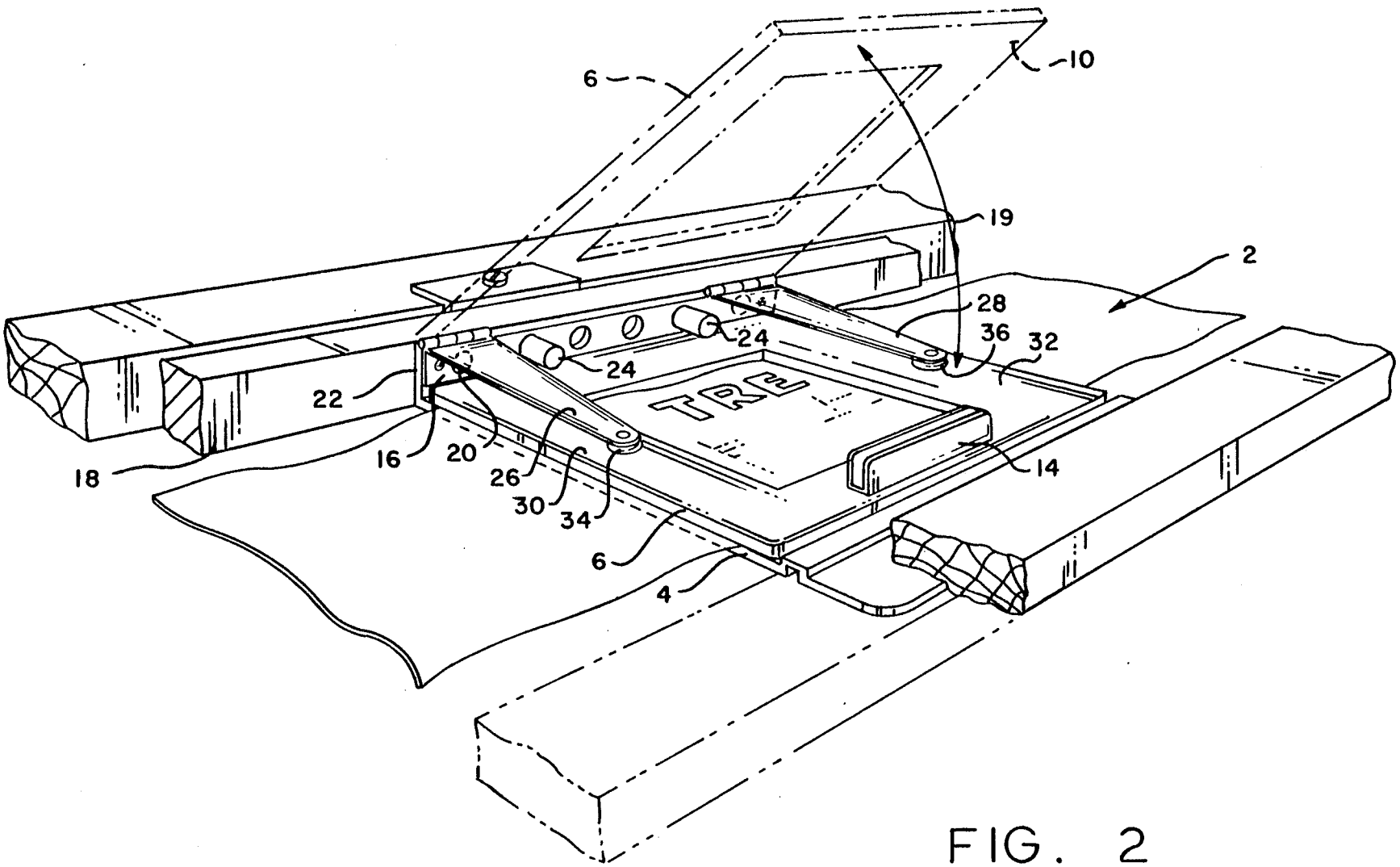
FIG. 2 is a perspective view of an alternate embodiment in accordance with the present invention shown mounted on a section of a pantograph table.

As shown in FIG. 2, hinge 16 may be utilized as an alternative means for effectively operating device 2 by allowing face frame member 6 in a controlled and predictable fashion to pivot relative to base frame member 4 and join therewith. In accordance with this alternative embodiment, hinge 16 is attached to the back plate 22 of base frame member 4. Back plate 22 is affixed to adapter 18 of a pantograph by inserting posts 24 into their corresponding holes 20. Extending forwardly from their respective ends of the hinge 16 are a pair of pivotally mounted arms 26 and 28 that engage separately the upper respective surfaces 30 and 32 of face frame member 6. A pair of rubber grommets 34 and 36 or any acceptable substitute is utilized as a spacer between the surfaces 30 and 32 and the respective end portions of mounted arms 26 and 28 to permit frame member 6 greater maneuverability and ease of alignment for remaining relatively level and controllable as members 4 and 6 are drawn together by the forces generated by the magnetic tape 12. Frame members 4 and 6 are generally rectangular in shape, though a variety of geometric shapes may be utilized according to the specific requirements and desires of the embroiderer.

In practice, an item of fabric or a section of an actual garment is placed over the base frame member 4 positioning the fabric or section of garment so that the area that will be embroidered is located inside the framework of the base. Face frame member 6 is then positioned above the fabric so that the surfaces 8 and 10 are properly aligned. Surfaces 8 and 10 are then brought together to coincide as exactly as possible. Once joined, the members 6 and 4 hold the material securely by virtue of the forces exerted by the magnetic tape 12. Adjustments to the fabric can then be made to insure a taut and flat working surface suitable for proper embroidering.

Figure 3:
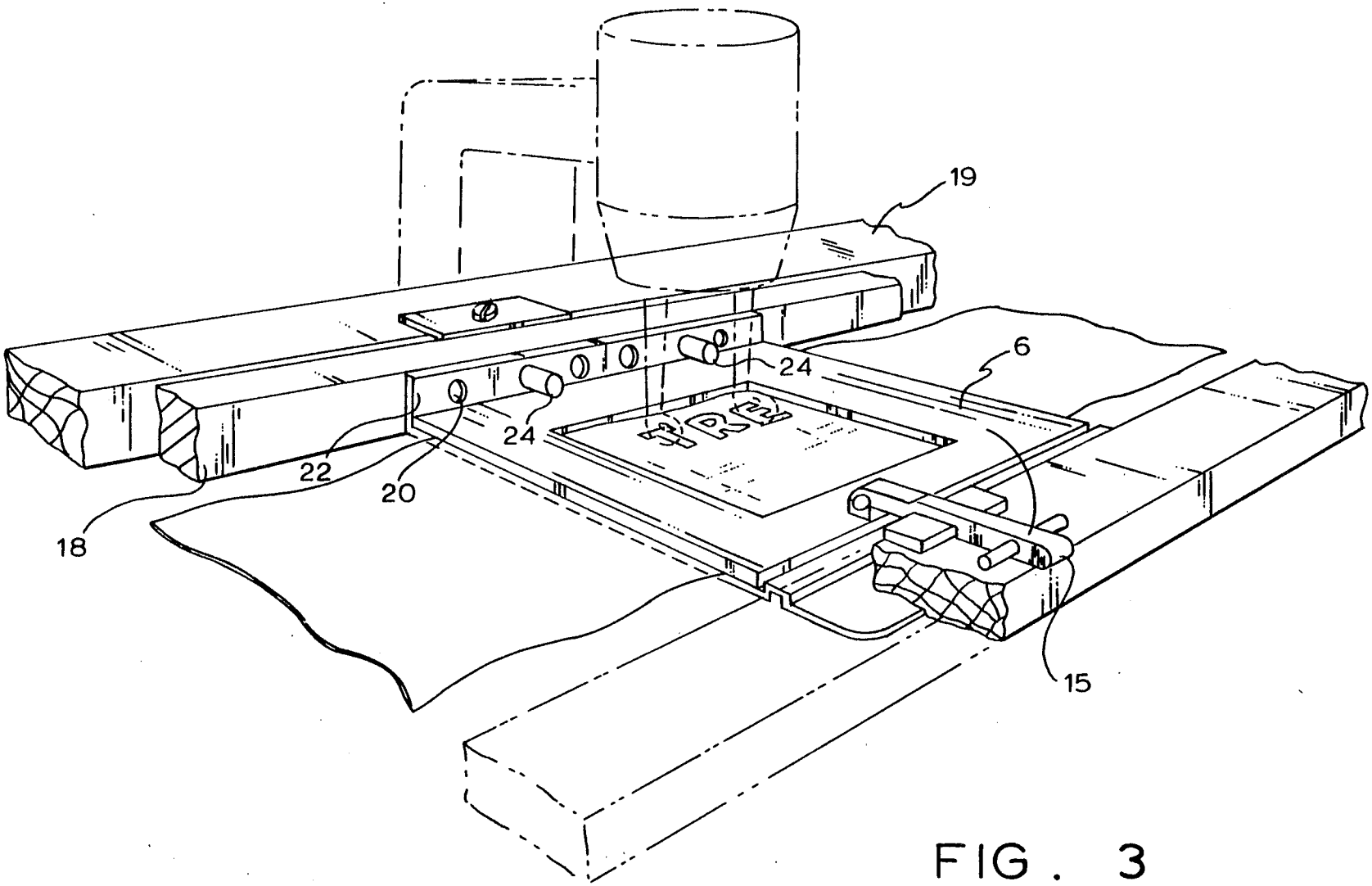
FIG. 3 is another alternative embodiment in accordance with the present invention shown mounted on a section of a pantograph table beneath a pantograph embroidery head depicted in phantom.

FIG. 3 depicts a second alternative embodiment of the present invention. Base member 4 contains a series of apertures 20 incorporated into the back plate 22 through which posts 24 are inserted to secure member 4 to an adapter 18 affixed to a pantograph. Apertures 20 also appear in FIG. 1 and are utilized in the same manner. Frame member 6 is guided by the operator into a proper alignment with the upper surfaces of member 4 and then slowly lowered until the magnetic forces exerted by tape 12 take hold and draw the two members into tight contact sandwiching the material firmly in between. Separation of the two members after the embroidering is finished is made relatively easy by simply pressing down on the end of lever 15 to lift member from member 4.

It is to be understood that the disclosed embodiments are merely exemplary of the invention, which may be embodied in various forms. Therefore, specific structural and functional details herein are not to be interpreted as limiting, but merely as a basis for the claims and as a representative basis for teaching one skilled in the art to employ the present invention in virtually any appropriately detailed structure.

I claim:

1. A device for use in the process of embroidering material comprising:

a frame, said frame including a base frame member generally rectangular in shape and a cooperating face frame member, each of said members consisting of a front and back portion and two side portions, said members including face opposed surfaces adapted with means to enable said face frame member to be releasably engageable with said base frame member for sandwiching therebetween material to be embroidered, said frame members being hingedly connected and including means to allow said face frame member increased maneuverability and accuracy of alignment when engaging said base frame member, and a means for releasably engaging said frame members comprising material employing a magnetic force affixed to the engageable and face opposed surfaces of said base frame member and said face frame member.

2. The device of claim 1 wherein said face frame member includes an upper surface, respectively, upon each of the two side portions and said means to allow said face frame member increased maneuverability and accuracy of alignment comprises a pair of arm members pivotedly connected to opposite ends of said hinged connection and extending forwardly therefrom to a first and second point corresponding to each of the respective said upper surfaces of said face frame member for attachment thereto, each of said arm members and the corresponding said point upon the surface of said face frame member to which each of said arm members is attached including a spacer means therebetween to act as a leveling agent when the face frame member is lowered towards and drawn to the base frame member by the forces exerted by the magnetic material.

* * * * *